US009327380B2

(12) United States Patent
Felten et al.

(10) Patent No.: US 9,327,380 B2
(45) Date of Patent: May 3, 2016

(54) LENS BLOCKING METHOD AND RELATED DEVICE

(75) Inventors: Yohann Felten, Charenton Le Pont (FR); Matthieu Le Gall, Charenton Le Pont (FR)

(73) Assignee: ESSILOR INTERNATIONAL (COMPAGNIE GENERALE D'OPTIQUE), Charenton Le Pont (FR)

( * ) Notice: Subject to any disclaimer, the term of this patent is extended or adjusted under 35 U.S.C. 154(b) by 1192 days.

(21) Appl. No.: 13/322,850

(22) PCT Filed: May 19, 2010

(86) PCT No.: PCT/EP2010/056865

§ 371 (c)(1),
(2), (4) Date: Nov. 28, 2011

(87) PCT Pub. No.: WO2010/136363

PCT Pub. Date: Dec. 2, 2010

(65) Prior Publication Data

US 2012/0074602 A1 Mar. 29, 2012

(30) Foreign Application Priority Data

May 27, 2009 (EP) ..... 09305487

(51) Int. Cl.
*B29D 11/00* (2006.01)
*B24B 13/005* (2006.01)

(52) U.S. Cl.
CPC ..... *B24B 13/0052* (2013.01); *B24B 13/0057* (2013.01)

(58) Field of Classification Search
USPC ..... 264/1.1, 2.5, 2.7; 425/808; 451/8, 9, 42
IPC ..... B24B 13/0052,13/0057
See application file for complete search history.

(56) References Cited

U.S. PATENT DOCUMENTS 6,012,965 A 1/2000 Savoie et al.
6,036,313 A 3/2000 Benjamin et al.

*Primary Examiner* — Mathieu Vargot
(74) *Attorney, Agent, or Firm* — Cozen O'Connor

(57) ABSTRACT

A method for blocking an optical lens (100) on a holding unit (200) thanks to a thermoplastic material layer (310) comprising the steps of: a) providing around the holding unit (200) a removable part (500) comprising an upper part surface (510) which is arranged so as to extend the upper assembling surface (210) of the holding unit and not to contact the bottom lens surface (120); b) providing a predetermined volume of a thermoplastic material; c) orientating the lens (100) in a desired spatial configuration; d) positioning the lens (100) contacting the thermoplastic material of step b) at a soften or melted state and pressing the lens (100) so as to keep the lens spatial configuration constant and to let the thermoplastic material flow from the upper assembling surface (210) of the holding unit to at least a part of the upper part surface (510) of the removable part (500); e) removing the removable part.

11 Claims, 3 Drawing Sheets

LENS BLOCKING METHOD AND RELATED DEVICE

RELATED APPLICATIONS

This is a U.S. National Phase Application under 35 USC 371 of International Application PCT/EP2010/056865 filed on May 19, 2010.

This application claims the priority of European application no. 09305487.2 filed May 27, 2009, the entire content of which is hereby incorporated by reference.

FIELD OF THE INVENTION

This invention relates to a lens blocking method and device for use in blocking an optical lens to a lens holding unit employed with machining, grinding and processing equipment in the generation of optical, namely ophthalmic, lenses.

BACKGROUND OF THE INVENTION

The process of preparing optical or ophthalmic lenses begins usually with an unfinished or semi-finished glass or plastic lens blank. Typically a semi-finished lens blank has a finished polished front surface and an unfinished back surface. By grinding away material from the back surface of the lens blank the required corrective prescription is generated. Thereafter the surface having had the corrective prescription imparted thereto is polished and the peripheral edge of the thus processed lens blank is provided with a final desired contour thereby establishing a finished optical or ophthalmic lens. According to other processing methods, the finished ophthalmic lens can be directly processed from a lens blank using for example three directional machining. The lens blank can be either a plastic or a glass lens blank.

It is necessary during these various processing operations to securely maintain the lens blank in accurate alignment and in place on the holding unit. This procedure is often referred to as "lens blocking".

Heretofore various materials were employed to secure the lens blank. These materials include glues, pitch and low temperature fusible metal alloys. The use of glues and pitch suffers the disadvantage of generally being non-reusable or non-reclaimable. The use of low temperature metal alloys caused significant environmental and health hazards especially since these alloys were most often fabricated from such metals as cadmium, tin, lead and bismuth.

To overcome these issues, organic low shrinkage materials have been developed to be used as lens blocking materials.

U.S. Pat. No. 6,036,313 in the name of 3M Innovative Properties Company discloses examples of compound families suitable for lens blocking with thermoplastic materials.

Preferred thermoplastic compositions are non-toxic, environmentally safe, preferably biodegradable and may be recycled. The thermoplastic material is solid at room temperature and has a low melting or softening point.

Blocking an optical lens on a holding unit thanks to a thermoplastic material layer may be obtained by providing a molten or softened thermoplastic material on an assembling surface of the holding unit and pressing the lens to be blocked.

Gaskets may be provided around the holding unit to limit the flow of the molten or softened thermoplastic material when pressing the lens.

U.S. Pat. No. 6,012,965 a method for blocking an ophthalmic lens blank to a support block.

Previous blocking methods are not fully satisfactory because this may lead to undesired positioning errors and/or insufficient blocking of the lens.

Accordingly, there remains a need for improving blocking a lens secured to a holding unit thanks to a thermoplastic material.

SUMMARY OF THE INVENTION

Thus, an object of the present invention is to improve blocking methods to enhance the blocking of the lens and then the quality of resulting lens.

This object is obtained according to one aspect of the invention directed to a method for blocking an optical lens, comprising an upper and a bottom lens surface, on a holding unit thanks to a thermoplastic material layer, the holding unit comprising a bottom part to be inserted and fixed in a lens machining tool and an upper part with an upper assembling surface, where the upper assembling surface is smaller than the bottom lens surface, said method comprising the steps of:

a) providing around the holding unit a removable part comprising an upper part surface which is arranged so as to extend the upper assembling surface of the holding unit and not to contact the bottom lens surface;

b) providing a predetermined volume of a thermoplastic material on the upper assembling surface or on a tape arranged on the upper assembling surface of the holding unit, where the predetermined volume is determined so as to obtain a desired shape and size of the thermoplastic material layer;

c) orientating the lens in a desired spatial configuration;

d) positioning the lens so as its bottom surface or the bottom surface of a tape stuck to the lens bottom surface contacts the thermoplastic material of step b) at a soften or melted state and pressing the lens so as to keep the lens spatial configuration constant and to let the thermoplastic material flow from the upper assembling surface of the holding unit to at least a part of the upper part surface of the removable part and form the desired shape and size of the thermoplastic material layer;

e) removing the removable part from around the holding unit after at least partial consolidation of the thermoplastic material layer.

The desired shape and size of the thermoplastic material layer is chosen and the volume of necessary thermoplastic material is determined, for example by calculation. The predetermined volume of thermoplastic material can be provided for example by a volumetric batcher. The lens is oriented in a desired spatial configuration so as to permit a machining tool to work the lens up to a desired shape.

When the desired spatial configuration is chosen and the lens oriented accordingly, it has to be stated that further steps of the method of the invention are implemented so as the spatial configuration of the lens remains constant. The wording "spatial configuration" is used to designate the spatial relationship of the lens in conjunction with the machining tool. It is clear that the lens moves during the different steps of the method of the invention, but the lens keeps a constant position in a virtual coordinate system attached to its machining position on the machining tool.

Thanks to providing a predetermined volume of thermoplastic material, orientating and maintaining the spatial configuration of the lens and permitting the thermoplastic material to flow out of the upper assembling surface of the holding unit, one can obtain a very reliable and efficient blocking method. Furthermore, no consumable parts, such as gaskets, are needed.

The thermoplastic material flows out of the upper assembling surface thanks to the removable part and can then be arranged on the lens on a surface wider than the projected surface of the upper assembling surface.

The inventors have demonstrated that enlarging the thermoplastic material layer on the bottom surface of the lens is very beneficial and may help lowering optical defects on the final lens.

Without being bound by a scientific theory, one can assume that providing a material layer that comprises a part extending on the lens wider than the upper assembling surface may reduce the vibration within the lens during machining.

According to an embodiment, the volume of thermoplastic material is calculated so as at least 90% of the bottom surface of the lens is covered by the thermoplastic material layer.

According to an embodiment, the volume of thermoplastic material is calculated so as the thermoplastic material layer covers the whole bottom surface of the lens.

According to different embodiments the lens may directly contact the thermoplastic layer or be separated from said layer by a tape; the thermoplastic layer may be provided directly on the upper assembling surface of the holding unit or on a tape arranged on said surface.

It has to be understood that the wording "contact the bottom lens surface" refers either to the actual bottom lens surface if no tape is provided on it or on the bottom surface of the tape if a tape is provided on the lens bottom surface.

According to different embodiments, that can be combined according to all possible combinations:

- the removable part has a wall slidingly movable on an external wall of the upper part of the holding unit;
- the removable part can be attached on, and further detached from the holding unit;
- the removable part is an expandable part;
- the holding unit comprises at least an external wall having an axial symmetry, where the symmetry axis is a vertical axis;
- the holding unit has an axial symmetry with said vertical symmetry axis;
- the removable part has an axial symmetry with the vertical symmetry axis of the external wall of the holding unit;
- the shape of the upper part of the holding unit is a cylinder of diameter D which external wall upper edge forms the perimeter of the upper assembling surface and where the removable part is an annular part which internal wall has a diameter D and can move slidingly along the external wall of the upper part.

According to further embodiments of the lens blocking method of the invention, which can be considered alone or in all possible combinations:

- the upper assembling surface of the holding unit is a spherical surface;
- the melting or softening point of the thermoplastic material is between 45° C. and 75° C.;
- the tape is an adhesive tape and may have a pressure-sensitive adhesive surface arranged to contact a bottom surface of an optical lens or the upper assembling surface of the holding unit and a tack-free adhesion promoting surface arranged to contact the surfaces of the thermoplastic material layer;
- the thickness of the thermoplastic material layer is between 0.5 mm and 2 mm, as for an example equal or less to 1 mm.

According to an embodiment, the holding unit is chosen within a series of N holding units where the bottom part of each holding unit has the same shape and size and where the upper parts of the N holding units of the series have increasing diameters (D1, D2, . . . DN) so as to provide N upper assembling surfaces of increasing surface, where N is an integer equal or greater to 2.

According to preceding embodiment, the removable part comprises at least two co-axial annular sliding parts each having an internal and external wall, where the internal wall of the first annular sliding part has the diameter D1 of the external wall of the upper part of the first holding unit of the series, the external wall of said first annular sliding part has the diameter D2 of the external wall of the upper part of the second holding unit of the series, the internal wall of the second annular sliding part has the diameter D2 of the external wall of the upper part of the second holding unit and where the upper part surface of the first, respectively the second, annular sliding part is the upper part surface arranged so as to extend the upper assembling surface of the first respectively the second, holding unit.

According to preceding embodiment, N is equal or greater to 3 and the removable part comprises N co-axial annular sliding parts where the internal wall diameter of the P annular sliding part is equal to the external wall diameter D(P−1) of the P−1 annular sliding part (i.e. the diameter of the external wall of the P upper part of the series), the external wall diameter of said P annular sliding part is equal to the diameter of the external wall of the P+1 upper part of the series, where P is at least 2 and equal or less to N−1, and where the upper part surface of the P annular sliding part is the upper part surface arranged so as to extend the upper assembling surface of the P holding unit.

The co-axial annular sliding parts may be moved manually or thanks to mechanical means. Said mechanical means may be controlled by automation and for example computer driven.

Thanks to those embodiments, one can offer a versatile blocking method suitable to handle a wide variety of lens sizes. One can then very easily adjust the desired thermoplastic material layer size by choosing a suitable holding unit and slidingly moving the suitable annular part to provide an extension of the upper assembling surface of the chosen holding unit.

The invention also relates to a holding unit blocking device for blocking an optical lens on an upper assembling surface of a holding unit comprising a bottom part to be inserted and fixed in a lens machining tool and an upper assembling surface for securing said lens, comprising a removable part comprising an upper part surface suitable to be arranged so as to extend the upper assembling surface of the holding unit and not to contact the bottom surface of the lens to be secured and wherein the removable part comprises at least two co-axial annular sliding parts each having an internal and external wall, where the internal wall of the first annular sliding part has the diameter D1 of the external wall of the upper part of a first holding unit, the external wall of said first annular sliding part has a diameter D2 of the external wall of the upper part of a second holding unit which upper part is larger than the upper part of the first holding unit, the internal wall of the second annular sliding part has the diameter D2 of the external wall of the upper part of the second holding unit and where the upper part surface of the first, respectively the second, annular sliding part is movable so as to be the upper part surface arranged so as to extend the upper assembling surface of the first, respectively the second, holding unit.

According to different embodiments of the holding unit blocking device:

- the removable part has a wall slidingly movable on an external wall of the upper part of the holding unit;

the holding unit and the removable part have an axial symmetry, where the symmetry axis is a same vertical axis.

The invention also relates to a holding unit blocking system comprising the preceding holding unit blocking device and further comprising:

positioning means for the holding unit;

a volumetric batcher for providing a predetermined volume of a thermoplastic material on the upper assembling surface;

means for orientating the lens in a desired spatial configuration;

means for pressing the lens on the thermoplastic material.

Another aspect of the present invention relates to a method of machining, such as for example grinding and/or polishing and/or edging and/or engraving, an optical lens comprising the steps of:

blocking the bottom surface of the optical lens using previously mentioned holding unit blocking device and/or according to previously mentioned method for blocking an optical lens;

inserting and fixing the bottom part of the holding unit in a lens machining tool;

machining the upper surface of the optical lens and/or edging said optical lens;

deblocking the machined optical lens.

According to the present invention, a thermoplastic material layer is a layer of material that can melt or soften when being heated. A thermoplastic material can be remelted or softened when heated and remoulded when cooling after melting or softening. Most thermoplastics are high molecular weight polymers whose chains associate through weak Tan der Waals forces (polyethylene); strong dipole-dipole interactions and hydrogen bonding (nylon); or even stacking of aromatic rings (polystyrene). Many thermoplastic materials are addition polymers; e.g., vinyl chain-growth polymers such as polyethylene and polypropylene. The thermoplastic material may also comprise additives (such as, for example, plasticizers, stabilizers, pigments, . . . ) and/or fillers (such as mineral and/or organic fillers, as for examples boron, carbon, clay, glass, cellulose, metals, oxides, aramide, polyamide, . . . ; fillers may be of different geometry, such as for example grains, lamella, short or long fibers, . . . ).

According to the present invention, an "optical lens" may be a lens which surfaces have already been machined, a semi-finished lens blank with a polished front surface, a lens blank with two unfinished surfaces.

The optical lens can be made for example, but not limited to, of plastic or glass. More generally, any combination of material suitable to obtain an optical system may be used. One or two surfaces of the optical lens may be coated.

Thus an "optical lens" of the invention can be every optical part that needs to be machined, as for example to be cut and/or grinded and/or polished and/or edged and/or engraved, in order to provide a machined optical lens.

A fully machined optical lens according to the present invention is for example an ophthalmic lens which surfaces form an optical system that fits a desired prescription. Said machined optical lens can be edged when blocked according to the present invention or edged in a further processing step, as for an example edged by an eye care practitioner.

The inventors have noticed that ophthalmic lenses manufactured using the blocking method according to the present invention have undamaged and quality reliable optical surfaces.

BRIEF DESCRIPTION OF THE DRAWINGS

Non limiting embodiments of the invention will now be described with reference to the accompanying drawing wherein.

DETAILED DESCRIPTION OF THE DRAWINGS

Skilled artisans appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention.

The wording "upper" or "on" and "bottom" or "under" indicates positions relative to the optical lens when it is arranged so as the edge of the optical lens to be machined is substantially situated in a horizontal plane.

Said position is purely conventional and the optical lens can be machined in a non horizontal position.

Figure 1:
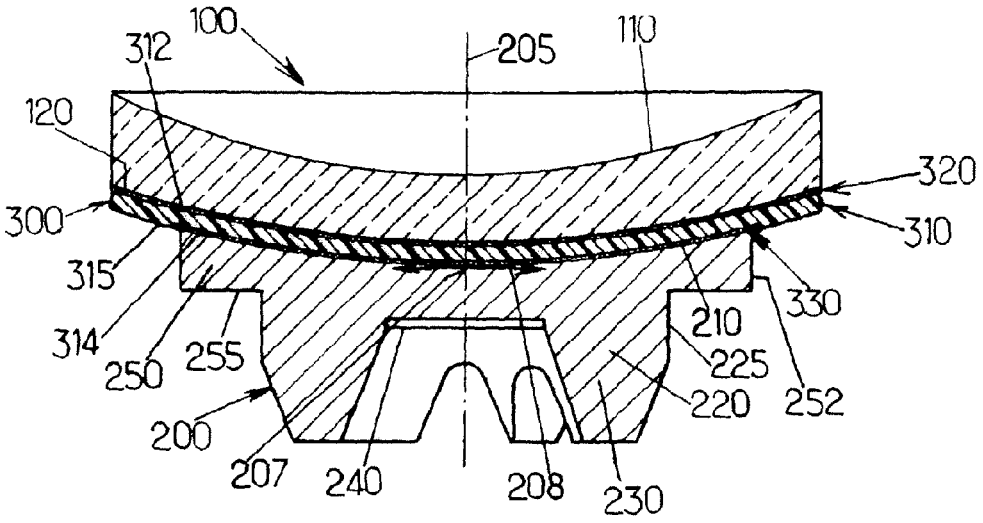
FIG. 1 is a cross sectional view of an optical lens fixed on a holding unit.

As shown on FIG. 1, an optical lens 100 is secured on a holding unit 200 thanks to fixing means 300. The edge of said optical lens 100 is substantially situated in a horizontal plane.

The upper surface 110 of the optical lens 100 is a surface to be machined, as for an example to be grinded and/or polished. The optical lens 100 can be further edged.

The bottom surface 120 of the optical lens 100 contacts the upper surface of the fixing means 300.

According to an embodiment, the optical lens 100 is a semi-finished lens blank and the bottom surface 120 is a finished optical surface.

As for an example, the external diameter of the optical lens 100 is between 50 mm and 100 mm, for example equal to 80 mm.

The holding unit 200 is a metallic part which comprises a bottom part 230, 220 and an upper part 250.

The lower part 230 of bottom part comprises means to orientate the holding unit in corresponding orientating means of a tool (not represented) of a lens machining unit such as a lathe or another movement inducing machine. Said tool may be a chuck or another fixing tool.

Internal surface 240 of the holding unit may contact an upper surface of said tool.

The bottom part of the holding unit also comprises a central part 220 which is a cylindrical part to be squeezed by said fixing tool of the machining unit.

Upper part 250 has an external diameter larger than the diameter of the central part 220 and its bottom surface 255 may lay on the upper surface of the tool of the lens machining unit and may comprise positioning means. The upper part 250 also comprises an upper assembling surface 210.

The holding unit 200 comprises external walls 225, 252 having an axial symmetry, where the symmetry axis 205 is a vertical axis. Said symmetry axis 205 passes through a point 207 situated in the center of the holding unit, where the tangent 208 of the assembling surface 210 is horizontal. The holding unit 200 has an axial symmetry, where the symmetry axis is the same vertical axis 205.

Fixing means 300 are arranged between the upper assembling surface 210 and the bottom surface 120 of the optical lens and consists of three stacked layers where:

- the first layer is an adhesive tape 330 which bottom surface 334 is fixed on upper assembling surface 210;
- the second layer is a layer 310 of thermoplastic material which bottom surface 314 is arranged on the upper surface 332 of the adhesive tape 330; the layer of thermoplastic material 310 comprises a part 315 extending wider than the upper assembling surface 210 and arranged so as to cover about the whole bottom surface 120 of the lens;
- the third layer is an adhesive tape 320 which bottom surface 324 is arranged on the upper surface 312 of the layer 310 of thermoplastic material;
- the bottom surface 120 of the optical lens is fixed on the upper surface 322 of the adhesive tape 320.

Said first and third layer are optional according to the present invention.

According to an embodiment, the thermoplastic material of the layer 310 melts or softens at a low temperature, less than the temperature at which the material(s) of the lens component may degrades or flows. Preferably the melting or softening point of the thermoplastic material is between 45° C. and 75° C. Suitable thermoplastic material may be selected from the group consisting of polyesters, polyurethanes, ionomer resins of ethylene copolymers, polyester-polysiloxane block copolymers, segmented copolyesters and polyetheresters, ethylene vinyl acetate resins and copolymers, waxes, polycaprolactones, and blends thereof.

Said thermoplastic material may comprise a homopolymer or copolymer of epsilon-caprolactone.

Examples of thermoplastic materials are given in previously cited U.S. Pat. No. 6,036,313 and are suitable for the present invention.

Figure 2:
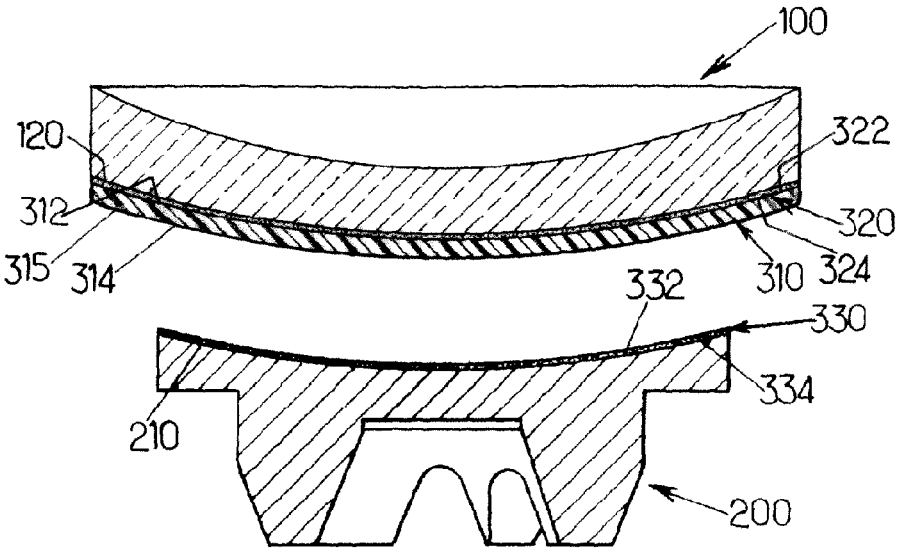
FIG. 2 is a cross sectional view of an example regarding deblocking step of said lens.

FIG. 2 shows an example of deblocking the lens after machining where the separation of the lens 100 and the holding unit occurs at the interface between the first layer 330 and the polymeric material layer 310. Deblocking the lens may also be obtained by hammering, by heating the polymeric material layer.

Figure 3:
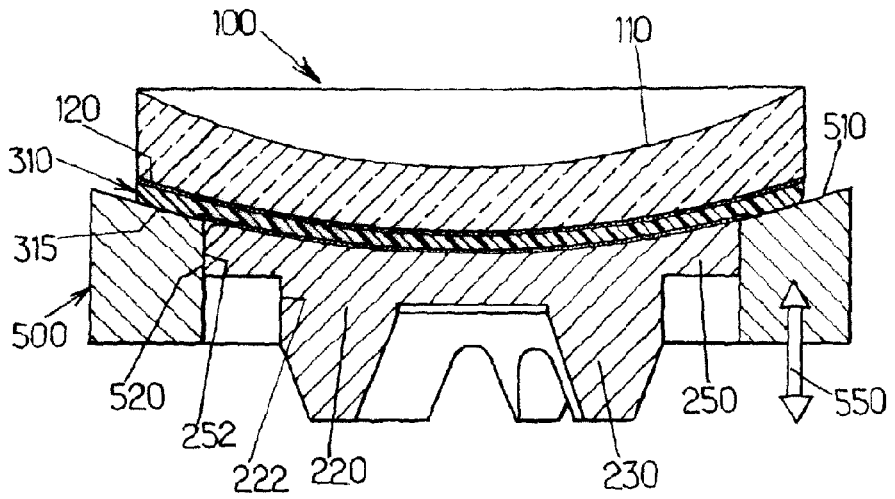
FIG. 3 shows cross section views of an example of a holding unit blocking device suitable to be used for the method of to the present invention.

FIG. 3 shows a holding unit blocking device suitable to be used for the method according to the invention which comprises a previously described holding unit 200 and a removable part 500 provided around said holding unit. The removable part 500 has an axial symmetry where the symmetry axis is the vertical symmetry axis 205 of the holding unit 200 and is an annular part which internal wall 520 has the same diameter than the diameter of the external wall 252 of the upper part 250 of the holding unit and can move slidingly along said external wall 252 according to arrow 550.

The upper part surface 510 of the removable part 500 is arranged so as to extend the upper assembling surface 210 of the holding unit and not to contact the bottom lens surface 120. This allows the predetermined volume of thermoplastic material provided on the upper assembling surface 210 (namely on the tape 330 arranged on the upper assembling surface 210) to flow to at least a part of the upper surface 510 of the removable part 500.

A desired shape of the thermoplastic material layer can be obtained where the size of said layer is wider than the size of the upper assembling surface 210 of the holding unit.

After blocking the lens 100 on the holding unit 200, the removable part 500 is removed and the lens plus holding unit system is placed on a machining tool.

Figure 4:
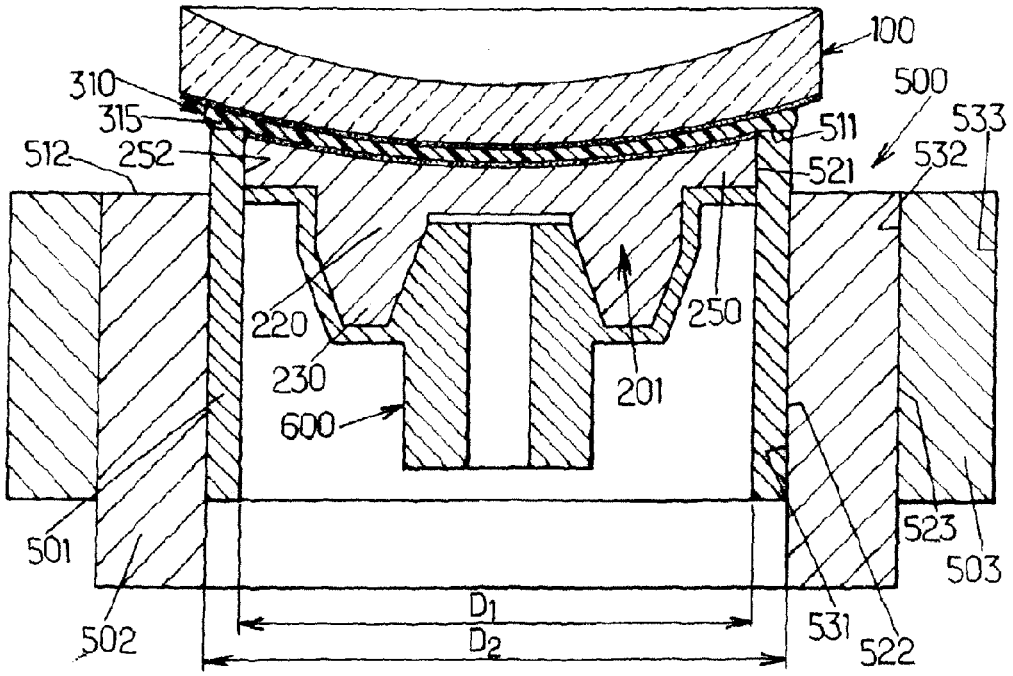
FIGS. 4 to 5 show cross section views of examples of holding unit blocking devices according to the present invention.
Figure 5:
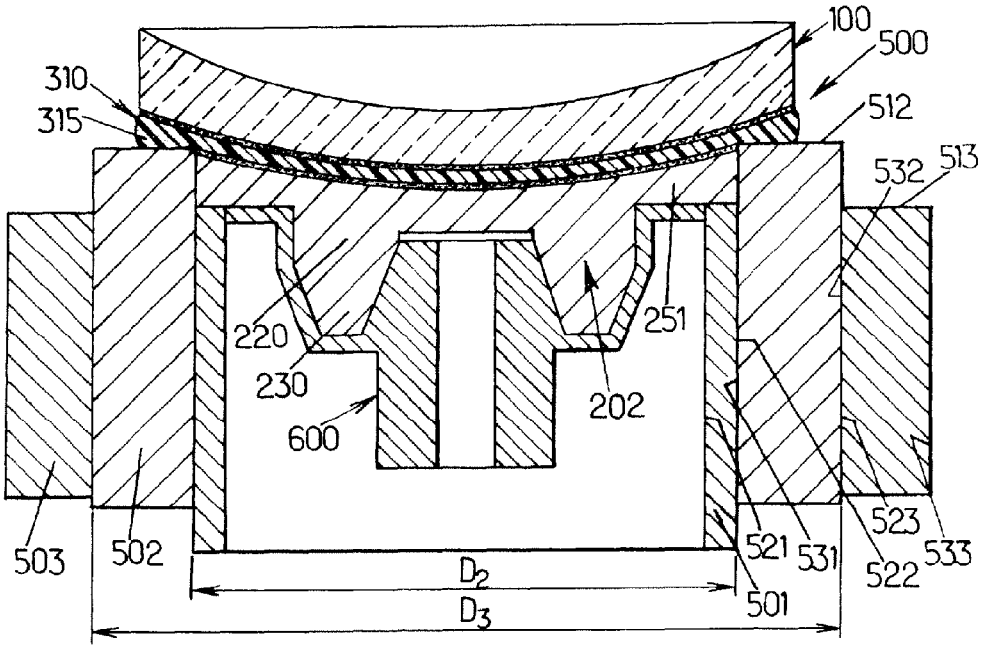

FIGS. 4 and 5 show embodiments of a holding unit according to the present invention where the same holding unit blocking device 500 is used for blocking a lens on two different holding units 201 and 202.

The holding units 201, 202 are part of a holding unit series where the bottom part 220, 230 of each holding unit has the same shape and size and where the upper part 250 of the first holding unit 201 has a diameter D1 smaller than the diameter D2 of the upper part 251 of the second holding unit 202.

Using said different holding units with identical bottom parts allows handling different lens sizes and keep unique positioning means for the holding units and identical assembling arrangement with the machining tool.

The holding unit 201, 202 is placed in a positioning part 600 comprising a cavity which walls contact the holding unit bottom part 220, 230. Said positioning part 600 may be cooled with water.

The holding unit blocking device of FIGS. 4 and 5 has a removable part 500 which comprises two co-axial annular sliding parts 501, 502 each having an internal 521, 522 and external 531, 532 wall, where the internal wall 521 of the first annular sliding part 501 has the diameter D1 of the external wall of the upper part of a first holding unit 201, the external wall 531 of said first annular sliding part 501 has a diameter D2 of the external wall of the upper part of a second holding unit 202 which upper part is larger than the upper part of the first holding unit, the internal wall 522 of the second annular sliding part 502 has the diameter D2 of the external wall of the upper part of the second holding unit 202 and where the upper part surface 511, 512 of the first, respectively the second, annular sliding part 501, 502 is movable so as to be the upper part surface arranged so as to extend the upper assembling surface of the first, respectively the second, holding unit 201, 202.

The second annular sliding part 502 is surrounded by a third annular sliding part 503 which internal wall 523 can slide on the external wall 532 of the second annular sliding part 502 and has a diameter D3. Said third annular sliding part 503 could be used to block a lens on a holding unit where the upper assembling surface would have a D3 diameter.

When using the first holding unit 201, the first annular sliding part surface 511 is the upper part surface which is arranged so as to extend the upper assembling surface of the holding unit 201 and not to contact the bottom lens surface 120 so as to let the thermoplastic material flow out of the upper assembling surface and let the thermoplastic material part 315 to be formed.

When using the second holding unit 202, the second annular sliding part surface 512 is the upper part surface which is arranged so as to extend the upper assembling surface of the holding unit 202 and not to contact the bottom lens surface 120 so as to let the thermoplastic material flow out of the upper assembling surface and let the thermoplastic material part 315 to be formed. The first annular sliding part 501 remains then under the bottom surface of the upper part of the second holding unit 202.

The invention has been described above with the aid of embodiments without limitation of the general inventive concept. In particular the present invention provides a method for blocking and/or deblocking all kinds of optical lenses, particularly ophthalmic lenses, e.g. single vision (spherical, torical), bi-focal, progressive, aspherical lenses (etc.), semi-finished optical lenses and/or blanks, blanks for manufacturing optical lenses.

The invention claimed is:

1. A method for blocking an optical lens, comprising an upper and a bottom lens surface, on a holding unit using a thermoplastic material layer, the holding unit comprising a bottom part to be inserted and fixed in a lens machining tool and an upper part with an upper assembling surface, where the upper assembling surface is smaller than the bottom lens surface, said method comprising the steps of:

a) providing around the holding unit a removable part comprising an upper part surface which is arranged so as to extend the upper assembling surface of the holding unit and not to contact the bottom lens surface;

b) providing a predetermined volume of a thermoplastic material on the upper assembling surface or on a tape arranged on the upper assembling surface of the holding unit, where the predetermined volume is determined so as to obtain a desired shape and size of the thermoplastic material layer;

c) orienting the lens in a desired spatial configuration;

d) positioning the lens so that its bottom surface or the bottom surface of a tape stuck to the lens bottom surface contacts the thermoplastic material of step b) at a softened or melted state and pressing the lens so as to keep the lens spatial configuration constant and to let the thermoplastic material flow from the upper assembling surface of the holding unit to at least a part of the upper part surface of the removable part and form the desired shape and size of the thermoplastic material layer;

e) removing the removable part from around the holding unit after at least partial consolidation of the thermoplastic material layer, wherein the holding unit comprises at least an external wall having an axial symmetry, where the symmetry axis is a vertical axis, wherein the removable part has an axial symmetry with the vertical symmetry axis of the external wall of the holding unit, wherein the shape of the upper part of the holding unit is a cylinder of diameter D which external wall upper edge forms the perimeter of the upper assembling surface and where the removable part is an annular part which internal wall has a diameter D and can move slidingly along the external wall of the upper part, wherein the holding unit is chosen within a series of N holding units where the bottom part of each holding unit has the same shape and size and where the upper parts of the N holding units of the series have increasing diameters (D1, D2, . . . DN) so as to provide N upper assembling surfaces of increasing surface, where N is an integer equal to or greater than 2, and wherein the removable part comprises at least two co-axial annular sliding parts, each having an internal and external wall, where the internal wall of the first annular sliding part has a diameter D1 of the external wall of the upper part of the first holding unit of the series, the external wall of said first annular sliding part has a diameter D2 of the external wall of the upper part of the second holding unit of the series, the internal wall of the second annular sliding part has the diameter D2 of the external wall of the upper part of the second holding unit and where the upper part surface of the first, and respectively the second, annular sliding part is movable so as to be the upper part surface arranged so as to extend the upper assembling surface of the first, and respectively the second, holding unit.

2. The method of claim 1, wherein the removable part has a wall slidingly movable on an external wall of the upper part of the holding unit.

3. The method of claim 1, wherein the removable part can be attached on, and further detached from the holding unit.

4. The method of claim 1, wherein the holding unit has an axial symmetry with said vertical symmetry axis.

5. The method according to claim 1, wherein N is equal to or greater than 3 and the removable part comprises N co-axial annular sliding parts where the internal wall diameter of the P annular sliding part is equal to the external wall diameter D(P−1) of the P−1 annular sliding part, the external wall diameter of said P annular sliding part is equal to the diameter of the external wall of the P+1 upper part of the series, where P is at least 2 and equal to or less than N−1, and where the upper part surface of the P annular sliding part is the upper part surface arranged so as to extend the upper assembling surface of the P holding unit.

6. A holding unit blocking device for blocking an optical lens on an upper assembling surface of a holding unit comprising a bottom part to be inserted and fixed in a lens machining tool and an upper assembling surface for securing said lens, comprising a removable part comprising an upper part surface suitable to be arranged so as to extend the upper assembling surface of the holding unit and not to contact the bottom surface of the lens to be secured and wherein the removable part comprises at least two co-axial annular sliding parts each having an internal and external wall, where the internal wall of the first annular sliding part has a diameter D1 of the external wall of the upper part of a first holding unit, the external wall of said first annular sliding part has a diameter D2 of the external wall of the upper part of a second holding unit which upper part is larger than the upper part of the first holding unit, the internal wall of the second annular sliding part has the diameter D2 of the external wall of the upper part of the second holding unit and where the upper part surface of the first, and respectively the second, annular sliding part is movable so as to be the upper part surface arranged so as to extend the upper assembling surface of the first, and respectively the second, holding unit.

7. The holding unit blocking device of claim 6, wherein the removable part has a wall slidingly movable on an external wall of the upper part of the holding unit.

8. The holding unit blocking device of claim 6, wherein the holding unit and the removable part have an axial symmetry, where the symmetry axis is a same vertical axis.

9. A holding unit blocking system comprising a holding unit blocking device for blocking an optical lens on an upper assembling surface of a holding unit comprising a bottom part to be inserted and fixed in a lens machining tool and an upper assembling surface for securing said lens, comprising a removable part comprising an upper part surface suitable to be arranged so as to extend the upper assembling surface of the holding unit and not to contact the bottom surface of the lens to be secured and wherein the removable part comprises at least two co-axial annular sliding parts each having an internal and external wall, where the internal wall of the first annular sliding part has a diameter D1 of the external wall of the upper part of a first holding unit, the external wall of said first annular sliding part has a diameter D2 of the external wall of the upper part of a second holding unit which upper part is larger than the upper part of the first holding unit, the internal wall of the second annular sliding part has the diameter D2 of the external wall of the upper part of the second holding unit and where the upper part surface of the first, and respectively the second, annular sliding part is movable so as to be the upper part surface arranged so as to extend the upper assembling surface of the first, and respectively the second, holding unit, the holding unit blocking system further comprising:

positioning means for the holding unit;

a volumetric batcher for providing a predetermined volume of a thermoplastic material on the upper assembling surface;

means for orientating the lens in a desired spatial configuration; and means for pressing the lens on the thermoplastic material.

10. The holding unit blocking system of claim 9, wherein the removable part of the holding unit blocking device has a wall slidingly movable on an external wall of the upper part of the holding unit.

11. The holding unit blocking system of claim 9, wherein the holding unit and the removable part have an axial symmetry, where the symmetry axis is a same vertical axis.

* * * * *